US006912960B2

(12) United States Patent
Tsai

(10) Patent No.: US 6,912,960 B2
(45) Date of Patent: Jul. 5, 2005

(54) DETACHABLE COMPUTER DESK

(75) Inventor: Chi-Cheng Tsai, Nantou (TW)

(73) Assignee: Sing Bee Enterprise Co., Ltd. (TW)

( * ) Notice: Subject to any disclaimer, the term of this patent is extended or adjusted under 35 U.S.C. 154(b) by 44 days.

(21) Appl. No.: 10/449,129

(22) Filed: Jun. 2, 2003

(65) Prior Publication Data

US 2004/0237852 A1 Dec. 2, 2004

(51) Int. Cl.[7] ..... A47B 37/00
(52) U.S. Cl. ..... 108/50.01; 108/92; 108/102
(58) Field of Search ..... 108/50.01, 50.02, 108/92, 101, 102; 248/241, 918, 298.1; 312/195, 196, 223.1, 223

(56) References Cited

U.S. PATENT DOCUMENTS 4,679,510 A * 7/1987 Veyhl et al. ..... 108/152
5,623,881 A * 4/1997 Huang ..... 108/50.01
5,947,034 A * 9/1999 Belka et al. ..... 108/50.01
5,967,631 A * 10/1999 Ko ..... 312/194
6,024,024 A * 2/2000 Favaretto ..... 108/64
6,182,579 B1 * 2/2001 Chang ..... 108/50.01
6,332,407 B1 * 12/2001 Vardaro ..... 108/50.01
6,786,161 B2 * 9/2004 Fischer ..... 108/50.01
2002/0113531 A1 * 8/2002 Ma ..... 312/223.3
2002/0189506 A1 * 12/2002 Hamilton et al. ..... 108/50.02
2003/0089283 A1 * 5/2003 Okamoto et al. ..... 108/50.02

FOREIGN PATENT DOCUMENTS

JP 09308530 * 12/1997
JP 2001245731 * 9/2001

* cited by examiner

*Primary Examiner*—Lanna Mai
*Assistant Examiner*—Hanh V. Tran
(74) *Attorney, Agent, or Firm*—Dennison, Schultz, Dougherty & MacDonald

(57) ABSTRACT

A detachable computer desk having a frame with two substantially inverted T-shaped legs, two crosspieces interconnected tops of the legs, and two fastening boards each including two parallel series of first apertures at both sides; a bracket assembly having a bar, two endpieces each having an opening, and C-shaped brackets slidable about the bar; shelves coupled to the brackets; a desk top coupled to the fastening boards; a notched member coupled to one leg, the notched member having two parallel columns of notches; an L-shaped computer seat having two parallel columns of second apertures and a lateral slit; and an L-shaped abutment plate opposite to a vertical section of the computer seat, the abutment plate being releasably secured to the slit. Height adjustments of both the computer seat and the desk top are made possible.

2 Claims, 7 Drawing Sheets

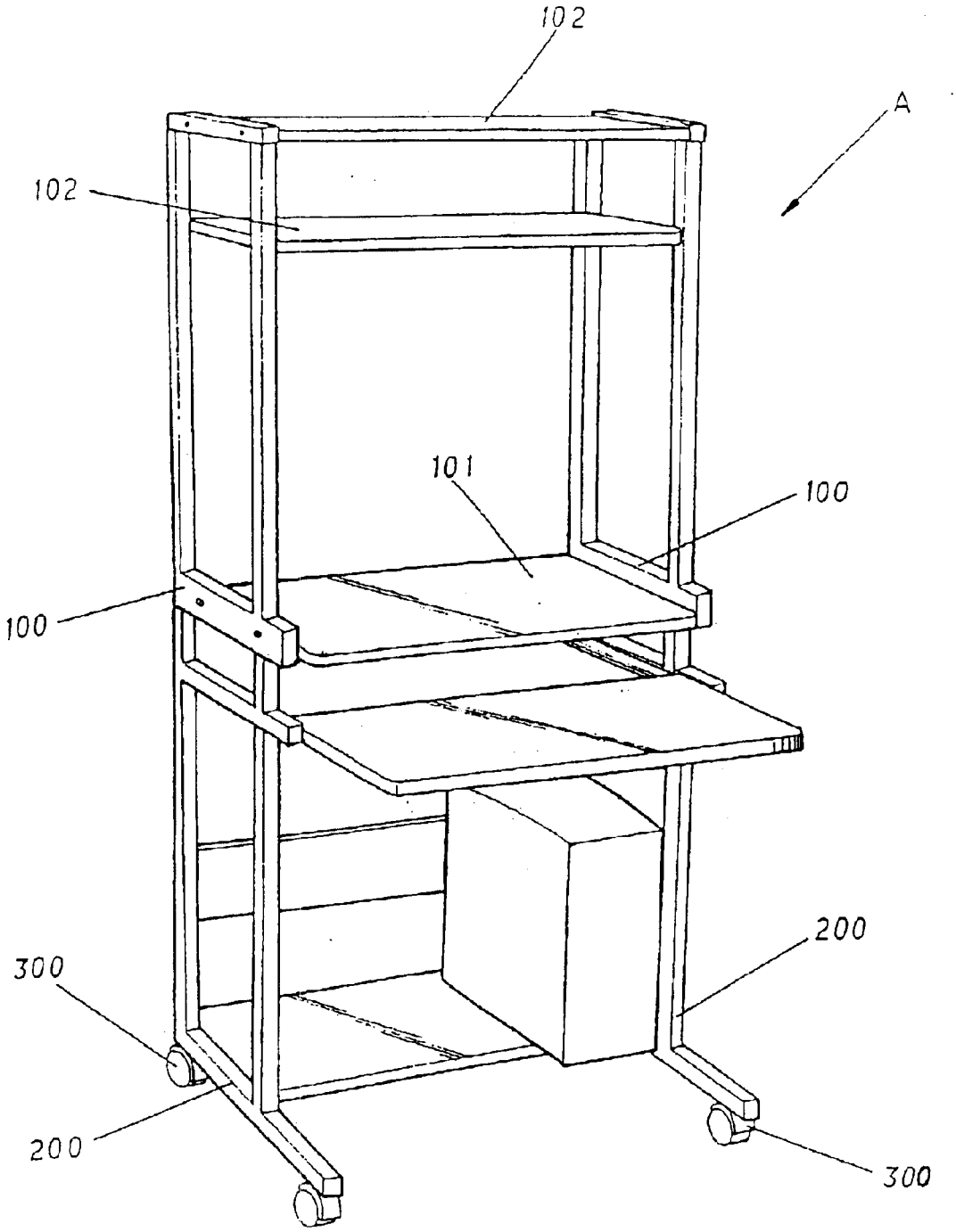
Fig・1
PRIOR ART

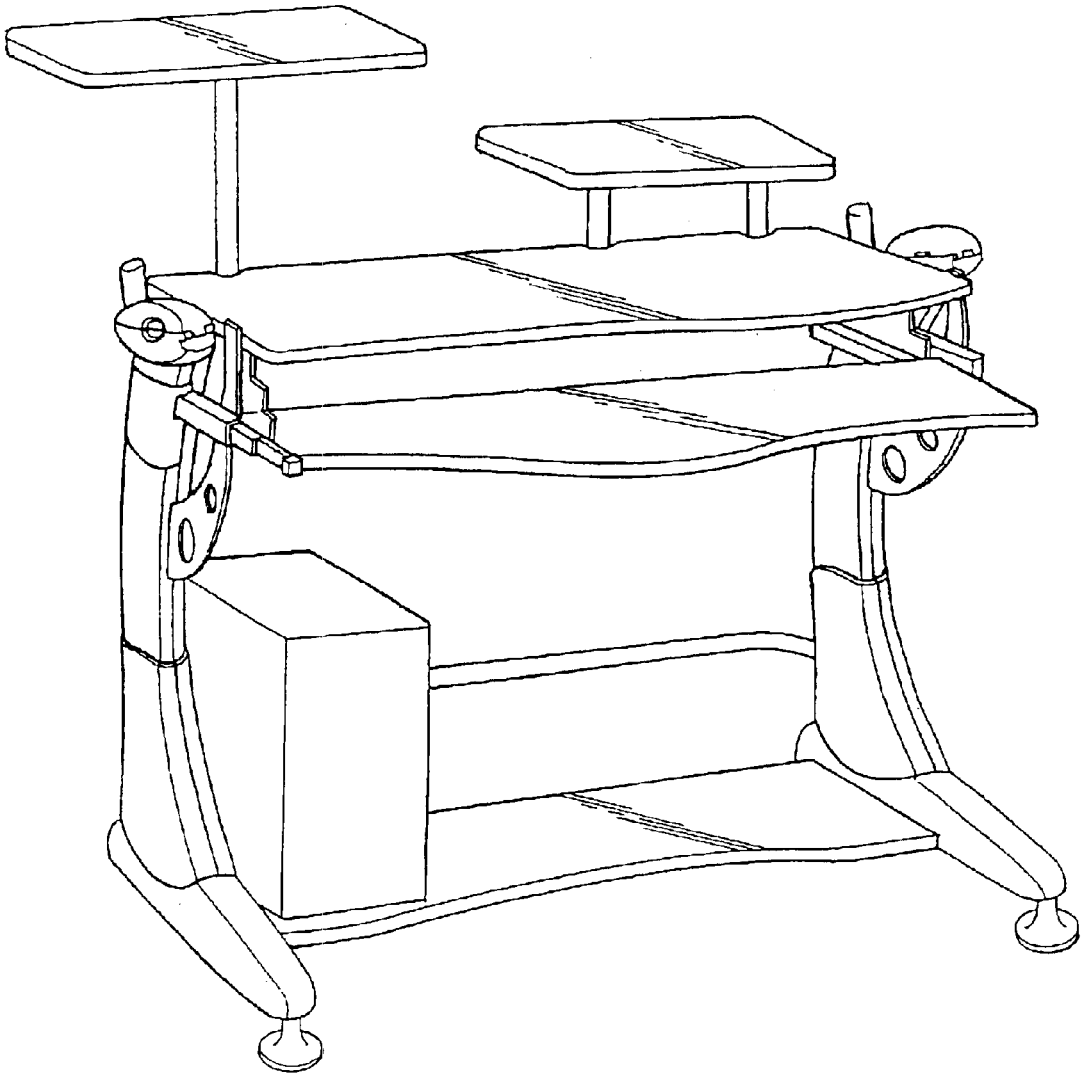
Fig・2
PRIOR ART

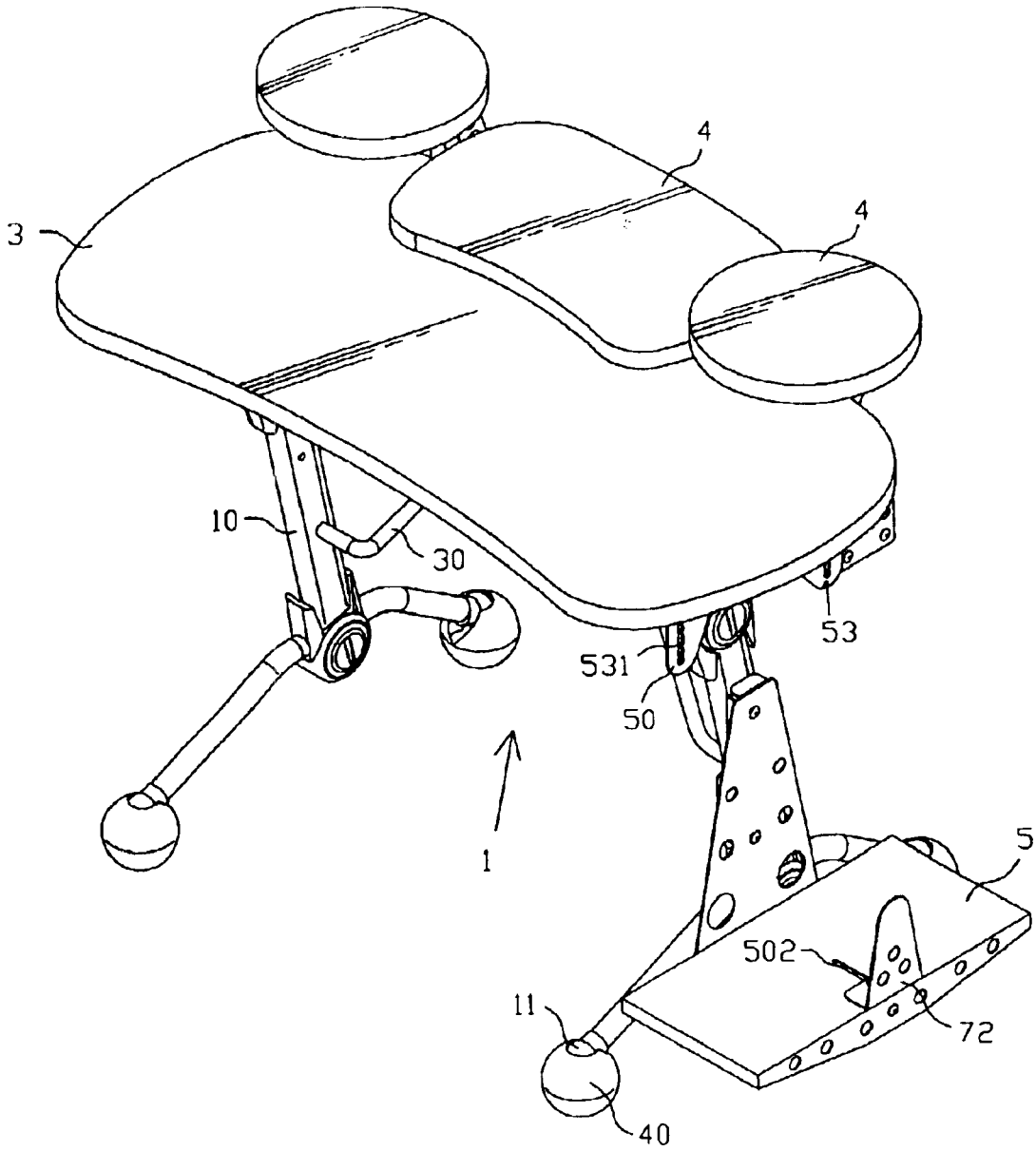
Fig • 3

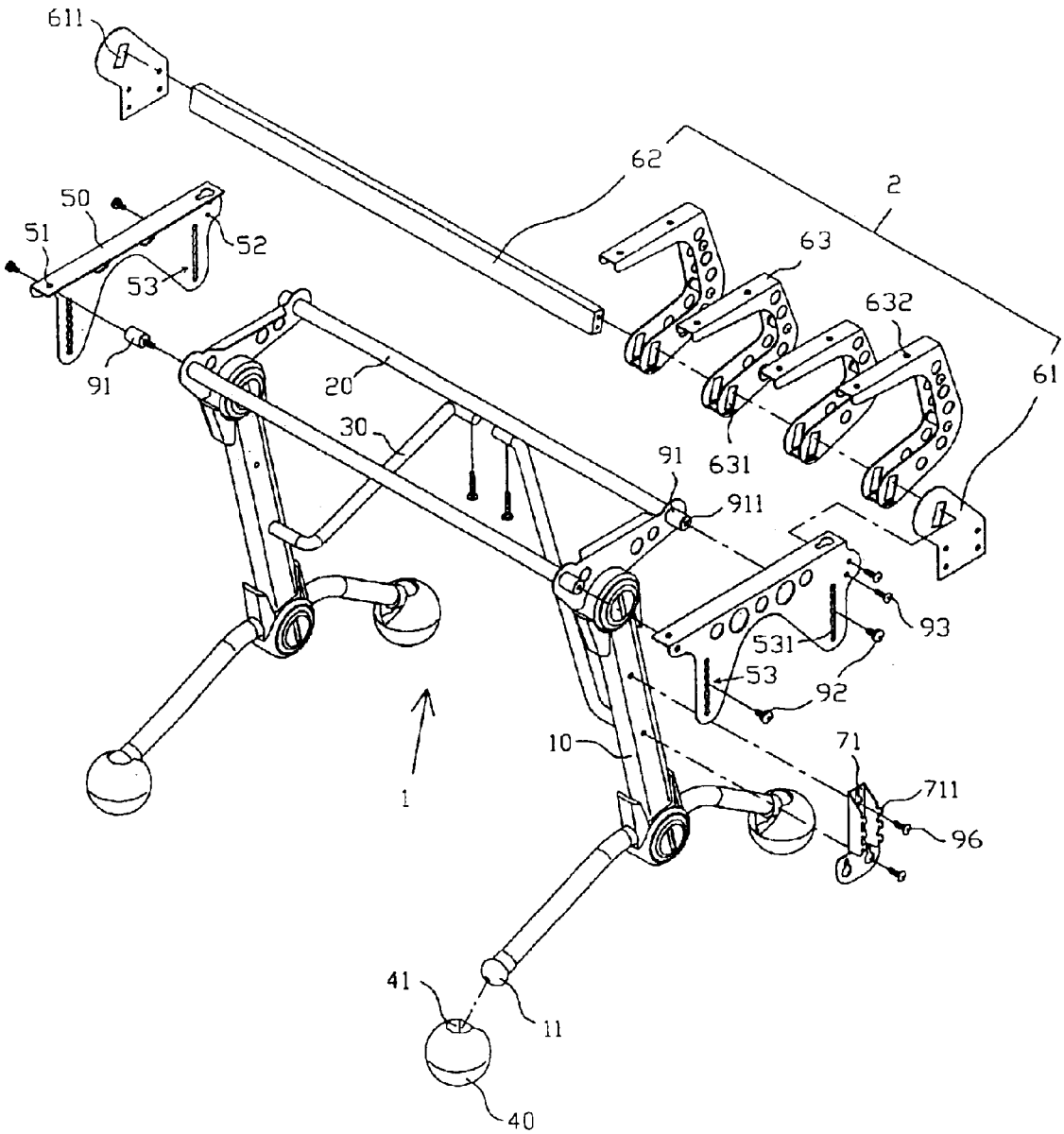
Fig • 4

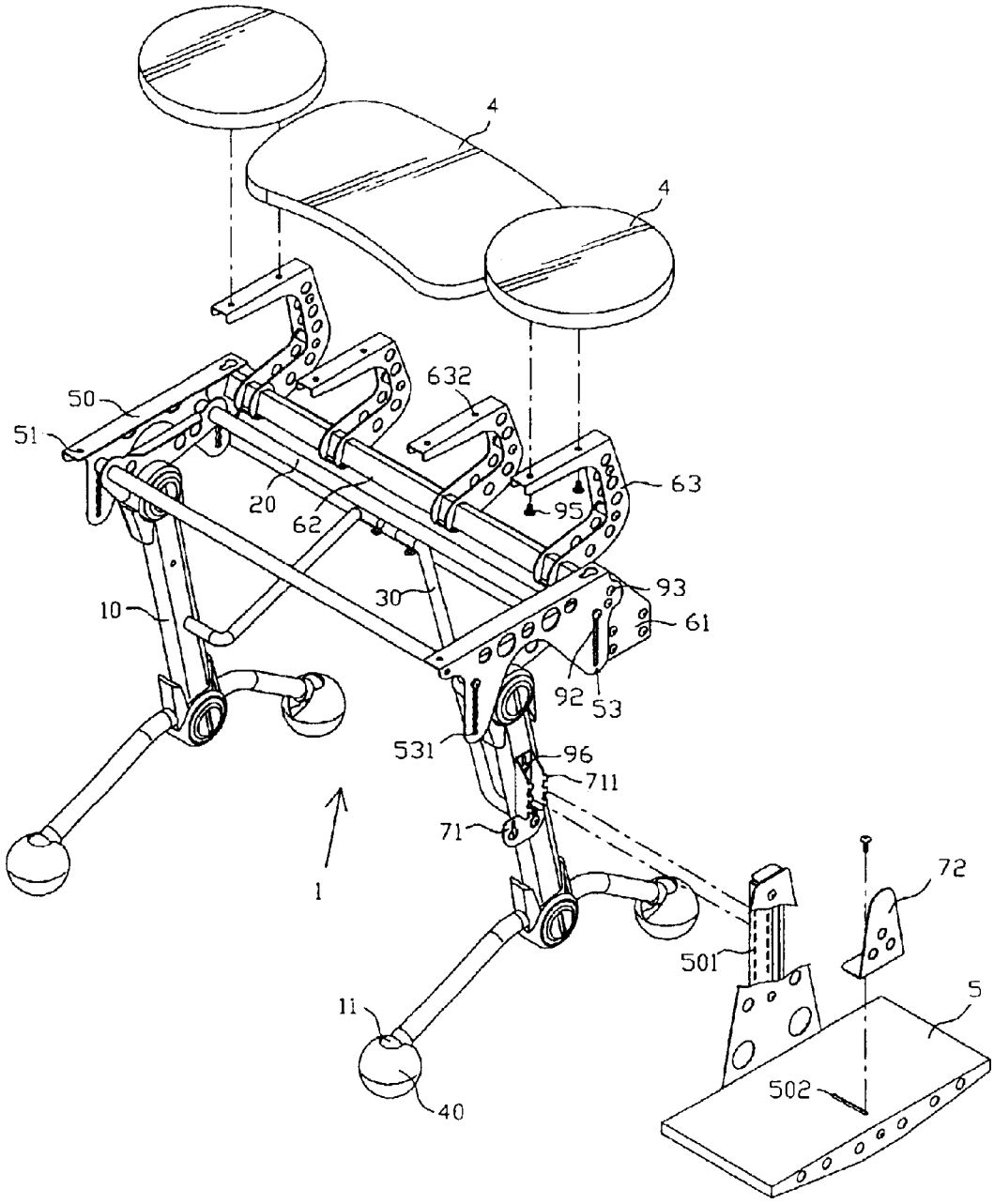
Fig • 5

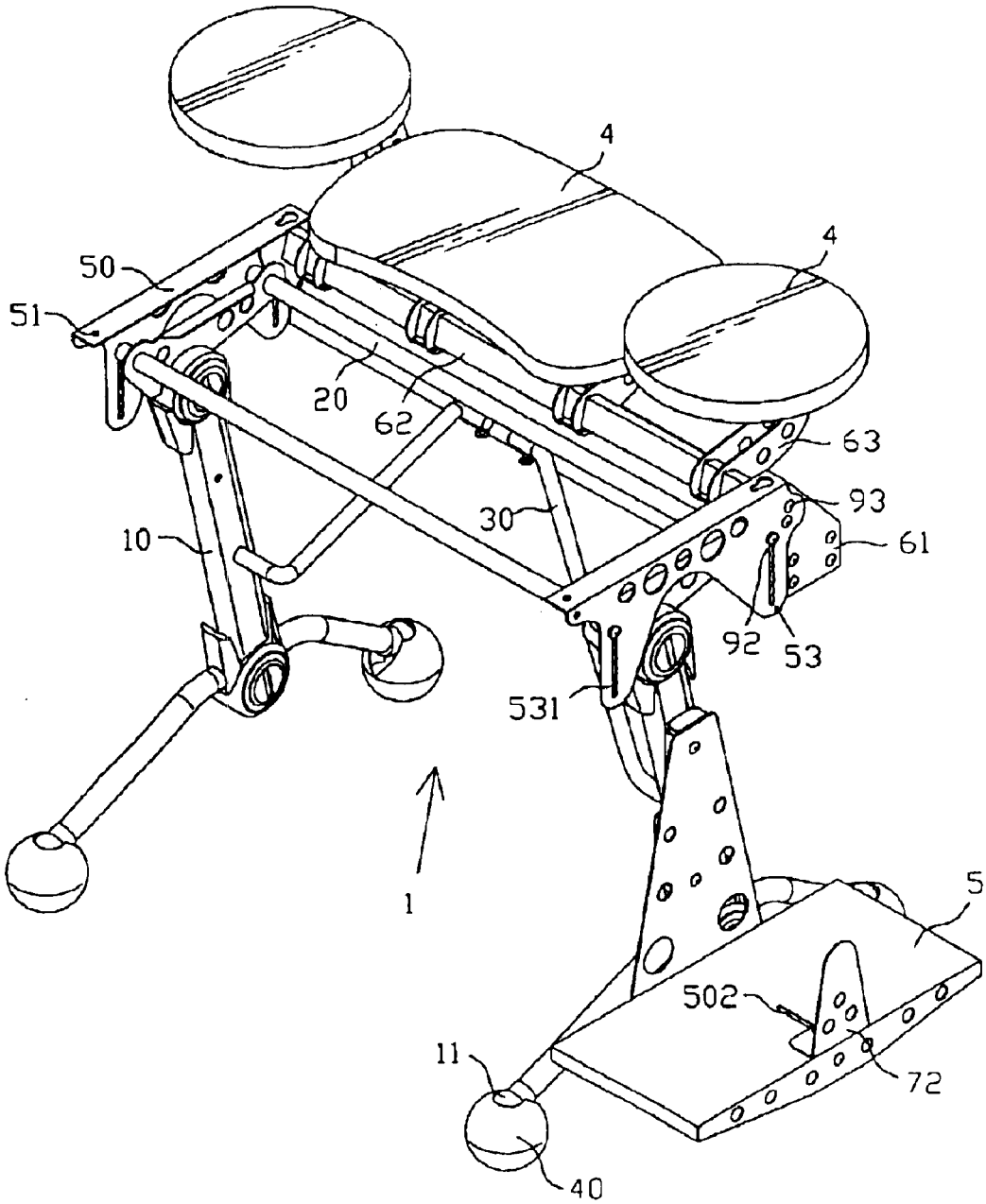
Fig • 6

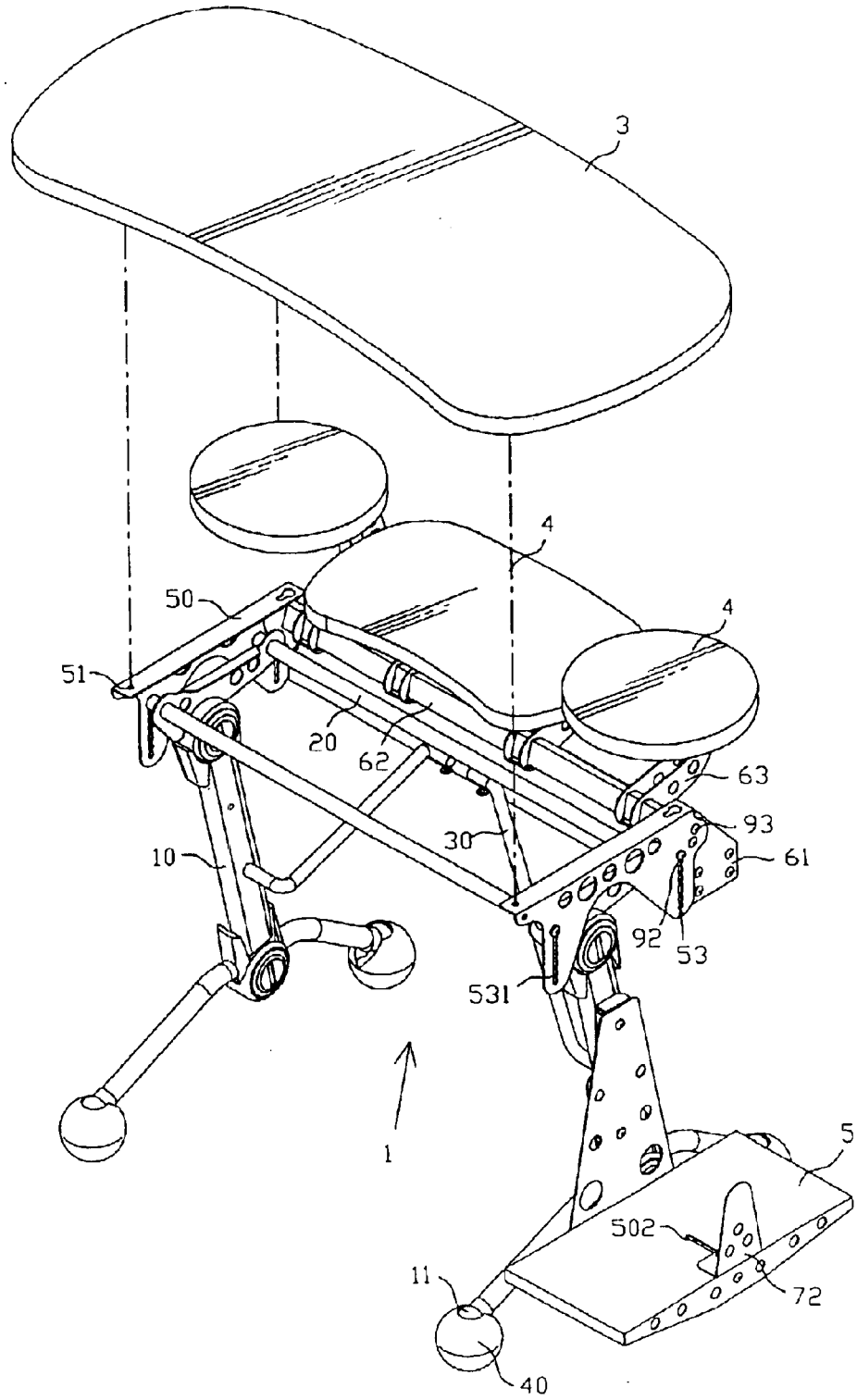
Fig • 7

DETACHABLE COMPUTER DESK

BACKGROUND OF THE INVENTION

1. Field of the Invention

The present invention relates to computer desks and more particularly to a detachable computer desk with improved characteristics.

2. Description of Related Art

A conventional computer desk A is shown in FIG. 1 and comprises a flat 101, two frame elements 100 extended upward from both sides of the flat 101, two upper shelves 102 interconnected the frame elements 100, two leg assemblies 200 extended downward from the frame elements 100, and four corner rollers 300 rotatably coupled to bottoms of the leg assemblies 200. However, the prior art suffered from several disadvantages. For example, its appearance is not attractive. Further, the legs of user may be hurt as they accidentally collide with two projected forward corners of the leg assemblies 200.

Another conventional computer desk as a modified version is shown in FIG.2. It has the advantages of being aesthetic and having less projecting members. However, the second prior art still suffered from several disadvantages. For example, its components are complicated. Its assembly is time consuming. Its shelves are fixed about flat. In other words, an adjustment of one or more computer components including peripherals (e.g., monitor, speakers, printer, etc.) is prohibited. Thus, the need for improvement still exists.

SUMMARY OF THE INVENTION

It is an object of the present invention to provide a detachable computer desk comprising a frame comprising two substantially inverted T-shaped legs pivotably coupled to a rounded glide, two crosspieces each interconnected tops of the legs, and two fastening boards each including two parallel series of first apertures at both sides so that two fasteners are adapted to drive through two flush ones of the first apertures into the crosspieces for securing the fastening board to the crosspieces; a bracket assembly comprising an elongated bar, two endpieces at both ends of the bar, each endpiece having a first opening slightly larger than a section of the bar, and a plurality of substantially C-shaped brackets each having a lower second opening about a size of the first opening so that the bar is adapted to insert through the first and the second openings to secure to the fastening boards and the second openings are slidable with respect to the bar; a plurality of shelves each coupled to the bracket so that positions of one of the brackets and the coupled shelf relative to the bar are adapted to adjust by sliding the bracket and the coupled shelf along the bar; a flat coupled to the fastening boards; a notched member coupled to one of the legs, the notched member comprising two parallel columns of a plurality of notches along an outer side; an L-shaped computer seat comprising two parallel columns of a plurality of second apertures on a vertical section and a lateral slit on a horizontal section; and an L-shaped abutment plate opposite to the vertical section of the computer seat, the abutment plate being releasably secured to the slit, wherein one of a plurality of pairs of the flush first apertures is adapted to insert into any one of a plurality of pairs of flush hooked peaks of the notched member for fastening the computer seat and the leg together.

In one aspect of the present invention the frame further comprises two opposite links each interconnected the bracket assembly and a vertical section of the leg.

The above and other objects, features and advantages of the present invention will become apparent from the following detailed description taken with the accompanying drawings.

BRIEF DESCRIPTION OF THE DRAWINGS

FIG. 1 is a perspective view of a conventional computer desk;

FIG. 2 is a perspective view of another conventional computer desk;

FIG. 3 is a perspective view of a preferred embodiment of detachable computer desk according to the invention;

FIG. 4 is a partial exploded view of FIG. 3;

FIG. 5 is an assembled view of FIG. 4 with the addition of a number of shelves and a shelf to be assembled;

FIG. 6 is an assembled view of FIG. 5; and

FIG. 7 is a perspective view of FIG. 6 with a flat to be assembled.

DETAILED DESCRIPTION OF THE PREFERRED EMBODIMENTS

Referring to FIGS. 3 to 7, a detachable computer desk constructed in accordance with the invention is shown. The desk comprises a frame 1, a bracket assembly 2, a flat 3, a plurality of shelves 4, and a computer seat 5 having a section of L. Each component will be described in detail below.

The frame 1 comprises two substantially inverted T-shaped legs 10 each having two ball joints 11 at ends of its horizontal section, the ball joint 11 being pivotably couple to a well 41 of a rounded glide 40 so that a support of the frame 1 on a supporting ground is more reliable and the frame 1 still can be stably supported on an uneven supporting ground, two crosspieces 20 each interconnected tops of the legs 10 by means of two fastening members 91, two opposite links 30 each interconnected the bracket assembly 2 and a vertical section of the leg 10 for providing an additional support of the frame 1, a threaded hole 911 in each fastening member 91, and two fastening boards 50 at the tops of the legs 10, each fastening board 50 having an arcuate bottom and including a top hole 51 for permitting a threaded secureness to the flat 3, a plurality of lateral holes 52 at one side for permitting a threaded secureness to the bracket assembly 2 (as detailed later), and two parallel series of apertures 53 at both sides for permitting two screws 92 to drive through two flush apertures 53 into the threaded holes 911 to secure the fastening boards 50 to the crosspieces 20. This arrangement enables a user to adjust a height of the flat 3.

The bracket assembly 2 comprises an elongated bar 62 having a rectangular section, two endpieces 61 at both ends of the bar 62, each endpiece 61 having a rectangular opening 611 slightly larger than the section of the bar 62, and a plurality of substantially C-shaped brackets 63 each having two top apertures 632 for permitting a threaded secureness to the shelves 4 and a rectangular opening 631 at a lower end about the size of the opening 611 so that the bar 62 is adapted to insert through the openings 611 and 631. Further, a plurality of screws 93 are driven into the lateral holes 52 of the fastening boards 50 and end holes of the bar 62 to secure the bar 62 and the fastening board 50 together. Note that the openings 631 are slidable with respect to the bar 62 so that positions of the bracket 63 and thus supported shelf 4 relative to the bar 62 can be adjusted by sliding the pair of bracket 63 and shelf 4 along the bar 62. In other words, relative positioning of two adjacent brackets 63 or the shelves 4 is made possible.

The flat 3 is threadedly secured to the fastening boards 50 by driving a plurality of screws 94 through the top holes 51 into the flat 3. Similarly, the shelves 4 are threadedly secured to the brackets 63 by driving a plurality of screws 95 through the top apertures 632 into the shelves 4.

A notched member 71 is threadedly secured to one of the legs 10 by means of a plurality of screws 96. The notched member 71 comprises two parallel columns of a plurality of notches 711 along an outer side. Correspondingly, two parallel columns of a plurality of apertures 501 are formed on a vertical section of the computer seat 5 so that any pair of flush apertures 501 can be inserted into a corresponding pair of flush hooked peaks of the notched member 71 for fastening the computer seat 5 and the leg 10 together. As a result, a purpose of adjusting height of the computer seat 5 is achieved. Moreover, the computer seat 5 comprises a lateral slit 502 on a horizontal section thereof so that an L-shaped abutment plate 72 opposite to the vertical section of the computer seat 5 can be secured to the horizontal section of the computer seat 5 by driving a bolt through the L-shaped abutment plate 72 and the slit 502 in cooperation with a nut. It is designed that a predetermined distance between the vertical section of the computer seat 5 and the L-shaped abutment plate 72 is adjustable. As such, any computer having a width different from the predetermined distance still can be reliably fastened between the L-shaped abutment plate 72 and the vertical section of the computer seat 5 while seated on the computer seat 5 by adjusting the bolt and nut combination.

While the invention herein disclosed has been described by means of specific embodiments, numerous modifications and variations could be made thereto by those skilled in the art without departing from the scope and spirit of the invention set forth in the claims.

What is claimed is:

1. A detachable computer desk, comprising:

a frame comprising two substantially inverted T-shaped legs pivotably coupled to a rounded glide, two crosspieces each interconnected tops of the legs, and two fastening boards each including two parallel series of first apertures at both sides so that two fasteners are adapted to drive through two corresponding and flush first apertures into the crosspieces for securing the fastening board to the crosspieces;

a bracket assembly comprising an elongated bar, two endpieces at both ends of the bar, each endpiece having a first opening slightly larger than a section of the bar, and a plurality of substantially C-shaped brackets each having a lower second opening about a size of the first opening so that the bar is adapted to insert through the first and the second openings to secure to the fastening boards and the second openings are slidable with respect to the bar;

a plurality of shelves each coupled to the bracket so that positions of one of the brackets and the coupled shelf relative to the bar are adapted to adjust by sliding the bracket and the coupled shelf along the bar;

a flat coupled to the fastening boards;

a notched member coupled to one of the legs, the notched member comprising two parallel columns of a plurality of notches along an outer side;

an L-shaped computer seat comprising two parallel columns of a plurality of second apertures on a vertical section and a lateral slit on a horizontal section; and an L-shaped abutment plate opposite to the vertical section of s the computer seat, the abutment plate being releasably secured to the slit, wherein one of a plurality of pairs of the flush first apertures is adapted to insert into any one of a plurality of pairs of flush notches (711) of the notched member for fastening the computer seat and the leg together.

2. The detachable computer desk of claim 1, wherein the frame further comprises two opposite links each interconnected the bracket assembly and a vertical section of the leg.

* * * * *